United States Patent [19]

Busch et al.

[11] Patent Number: 4,715,303

[45] Date of Patent: Dec. 29, 1987

[54] LUBRICATING DEVICE FOR SEWING AND EMBROIDERING MACHINES

[75] Inventors: Edgar Busch, Trippstadt; Lothar Schilling; Klaus Ziegler, both of Kaiserslautern, all of Fed. Rep. of Germany

[73] Assignee: Pfaff Industriemaschinen GmbH, Fed. Rep. of Germany

[21] Appl. No.: 870,076

[22] Filed: Jun. 3, 1986

[30] Foreign Application Priority Data

Jun. 3, 1985 [DE] Fed. Rep. of Germany ..... 8516167

[51] Int. Cl.[4] ..... D05B 57/08; D05B 71/02

[52] U.S. Cl. ..... 112/256; 112/231; 184/39.1; 384/465

[58] Field of Search ..... 112/43, 231, 98, 256, 112/232; 384/465; 184/615, 39.1

[56] References Cited

U.S. PATENT DOCUMENTS

| | | | |
|---|---|---|---|
| 3,084,648 | 4/1963 | Ketterer | 184/6.15 X |
| 4,073,251 | 2/1978 | Schrudde | 112/256 |
| 4,350,105 | 9/1982 | Albrecht et al. | 184/6.15 |
| 4,393,798 | 7/1983 | Cheng | 112/256 X |
| 4,522,136 | 6/1985 | Wolff et al. | 112/256 |

FOREIGN PATENT DOCUMENTS

| | | | |
|---|---|---|---|
| 3215408 | 10/1983 | Fed. Rep. of Germany . | |
| 1334454 | 10/1973 | United Kingdom | 384/465 |

*Primary Examiner*—Andrew M. Falik

*Attorney, Agent, or Firm*—McGlew and Tuttle

[57] ABSTRACT

A lubricating device for a revolving lock stitch shuttle of machines such as sewing and embroidering machines comprises a shuttle body which has a hub portion which surrounds its associated shuttle arbor and which lies adjacent a bearing mounting for the arbor. The hub portion is hollow and defines a lubricating oil chamber between it and the associated bearing and a gap between the shuttle hub portion and the associated bearing is bridged by a fixed ring member which is carried on a bracket which is secured to the bearing. The ring member has an opening therethrough providing an access for a nozzle tube for feeding oil from an external reservoir to the hub recess from when the oil is advanced by the centrifugal force of the rotation of the shuttle to the periphery of the shuttle.

6 Claims, 2 Drawing Figures

LUBRICATING DEVICE FOR SEWING AND EMBROIDERING MACHINES

FIELD AND BACKGROUND OF THE INVENTION

This invention relates in general to lubricating devices particularly for sewing machines and embroidering machines, and in particular to a new and useful lubricating device for a loop taker which oil is fed from a reservoir by the action of a pump through a recess or oil chamber defined in a hub portion of the loop taker.

A lubricating device disclosed in German Patent No. 32 15 408 provides as oil feed to the oil chamber a disk revolving with the loop taker, which disk, by contact with a wick connected with an external oil reservoir, takes up oil from the reservoir and flings it into the oil chamber by centrifugal action, whence it passes via a bore to a sealed cavity and thence via another bore to the track of the loop taker. This type of oil feed requires some additional structural measures at the loop taker.

For lead through of the loop taker drive shaft and of a ring which surrounds it and annularly receives the wick and which partially extends into the oil chamber, the opening through which the ring extends into the oil chamber is somewhat larger than the diameter of the ring. Thus the oil chamber has an open connection to the space in which during sewing especially much fuzz or dust accumulates, whereby the lubricating oil may be fouled and thus the lubricating action reduced.

SUMMARY OF THE INVENTION

The invention insures against the penetration of fuzz or dust into the oil chamber and provides an especially simple arrangement which is suitable for several types of oil feed. By the lubricating device according to the invention, the penetration of dust into the oil chamber in the loop taker body is effectively prevented. The oil feed occurs through a simple nozzle tube which permits pressureless dropwise feed or an oil feed under pressure as oil spray, oil jet, etc., and which can be firmly attached to the ring itself which causes the shielding of the oil chamber.

Construction is especially suitable for drop feeding of lubricating oil by gravity. Another construction is advantageous for oil feed under pressure in dependence on the rotational speed of the machine. A counter counts the number of revolutions of the drive shaft of the machine. After a predeterminable value has been reached in the counter, a signal is given out with which a lubricating process is triggered, so that the oil supply always occurs at the optimum, settable time as a function of the rotational speed of the machine. This means that at higher speed the time intervals between the lubricating processes are shorter than at lower speed. With the single stroke of the pump, e.g. a piston pump, which is infinitely variable, the pump delivers at every stroke a given quantity of oil. In another arrangement, this oil is divided by the interposed oil distributor over a plurality of lines. Thus the track of each loop taker receives at predeterminable intervals the needed dosed quantity of oil. The oil lines of the lubricating device are completely filled with oil. Therfore the entire quantity of oil displaced during a pump emerges without delay from the nozzle tubes at the end of the conduit and reaches the lubrication points of the loop taker.

Accordingly it is an object of the invention to provide an improved lubricating system particularly for a loop taker of a sewing or embroidering machine with a track of a rotating lock stitch loop taker.

A further object of the invention is to provide a lubricating system which is simple in design, rugged in construction and economicl to manufacture.

The various features of novelty which characterize the invention are pointed out with particularity in the claims annexed to and forming a part of this disclosure. For a better understanding of the invention, its operating advantages and specific object attained by its uses, reference is made to the accompanying drawings and descriptive matter in which preferred embodiments of the invention are illustrated.

DESCRIPTION OF THE PREFERRED EMBODIMENTS

Figure 2:
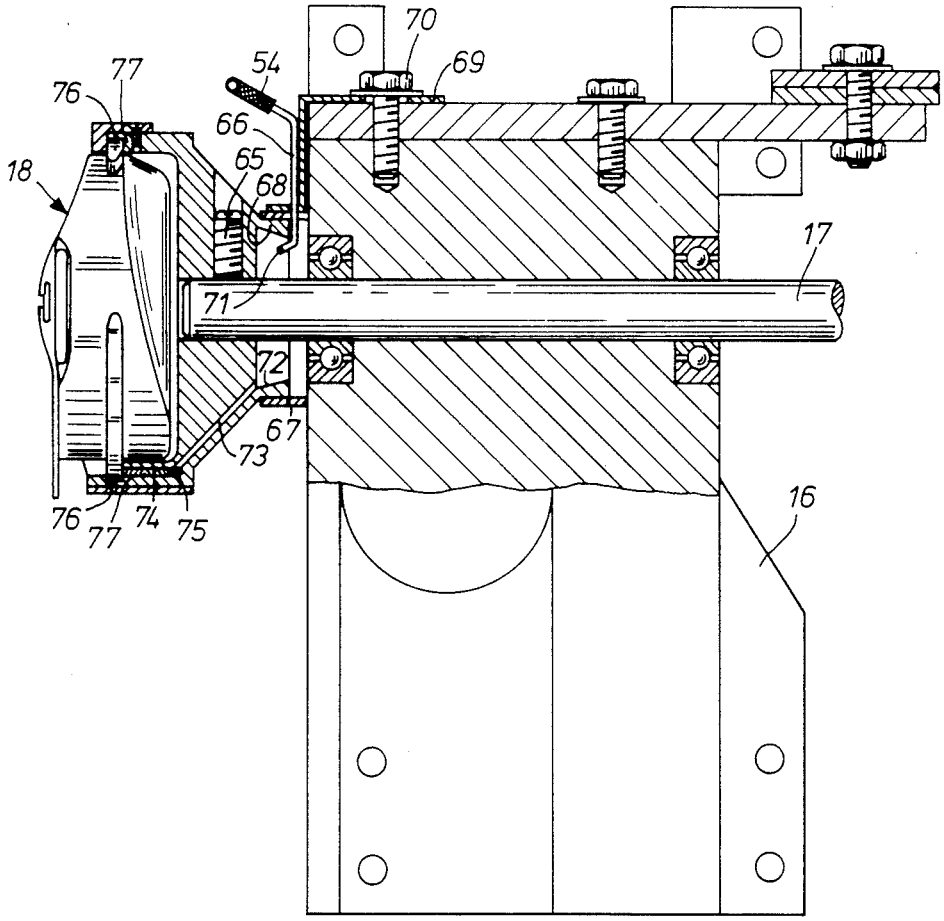
FIG. 2 is an enlarged sectional view of the lubricating oil supply at a loop taker.

Referring to the drawings in particular, the invention embodied therein comprises a lubricating device for the track of a revolving lock stitch loop taker of a sewing or embroidering machine which includes a loop taker body 18 having a hub portion 68 as shown in FIG. 2 which is closed on the end facing a fixed bearing block 16 for a loop taker arbor 17. In accordance with the invention the lubricating oil is directed from an oil line 54 through a discharge 71 into an oil chamber 72 defined between the hub portion 68 and the bearing block 16. The oil chamber is covered free from dust by a fixed ring 67 which is affixed on a bracket 69 secured to the bearing block 16 by a screw 70.

Figure 1:
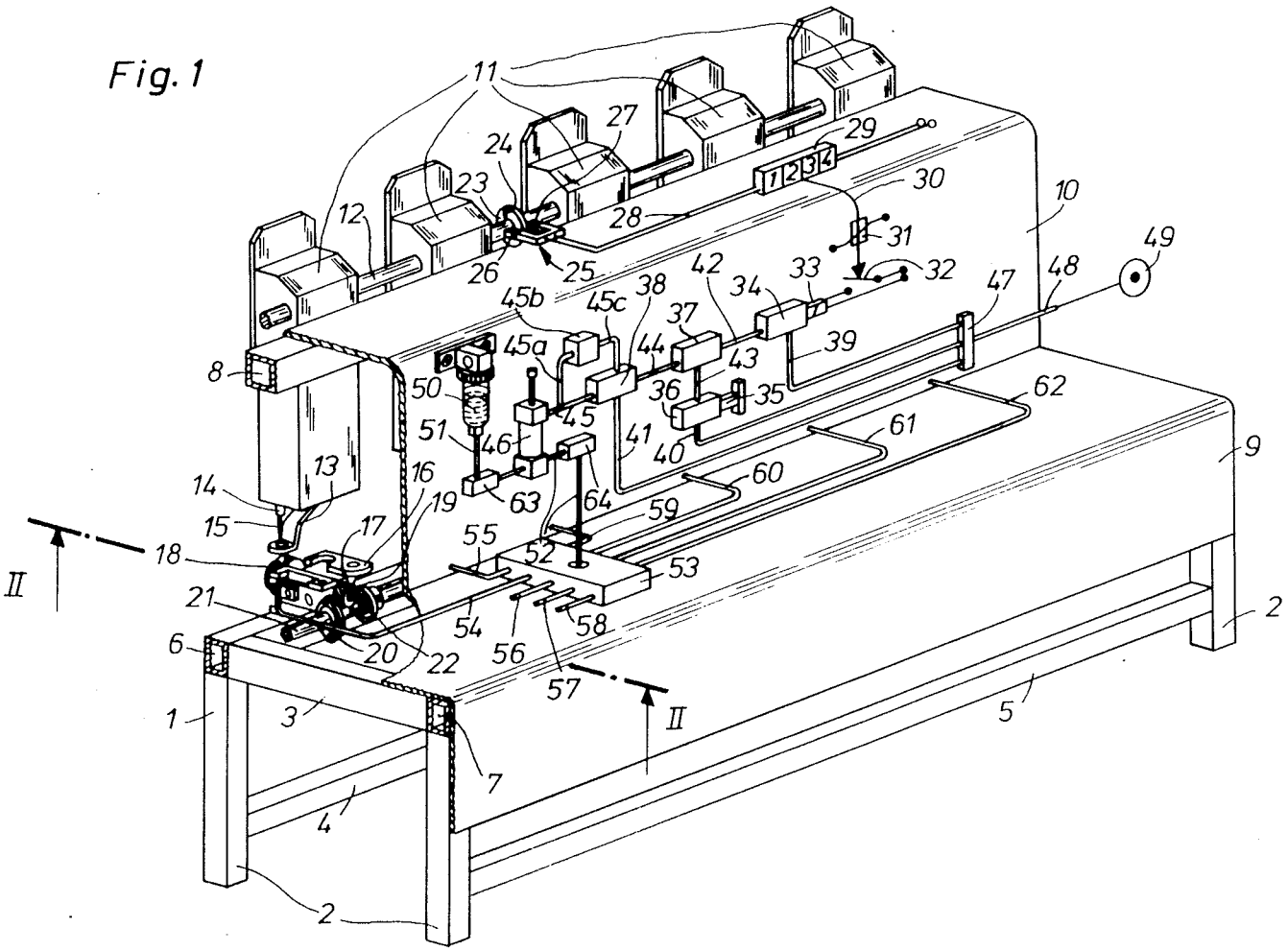
FIG. 1 is a perspective partially sectional view of a multi-head embroidering machine provided with the lubricating device.

The multi-head embroidering machine illustrated in FIG. 1 is arranged on a support structure 1 which comprises legs 2, horizontal cross bars 3 and longitudinal struts 4 to 7, as well as a horizontal longitudinal beam 8. The support structure 1 is covered by panels 9 and 10. Embroidering heads 11 on beam 8 are provided on their underside with the presser feet 13 necessary for the embroidering process as well as with the needle bars 14 to hold the thread carrying needles 15 and are coupled for joint drive by the main shaft 12.

On the longitudinal strut 6, bearing blocks 16 for the suspension of loop taker arbors 17 are attached. At one end the loop taker arbors 17 serve to receive rotating lockstitch loop takers 18, while the other end is connected with a helical gear 19 for each.

A bearing point 20 for receiving a loop taker drive shaft 21 is part of each of the bearing blocks 16. Ring gears 22 arranged non-rotational on the loop taker drive shaft 21 are in continuous engagement with the helical gears 19 for the drive of the loop taker arbors 17 and hence of the huttles 18.

The following parts are needed for lubrication of the individual lubricating points: On the main shaft 12 of the multi-head embroidering machine a counting disk 23 with a slit-like opening 24 is fastened. Pulse generator means including a scanning device 25 with a transmitter 26 and a receiver 27 records e.g. optoelectrically or electromagnetically the number of revolutions of the main shaft 12 and sends the signal let through by the opening 24 per revolution and received by the receiver 27, via the connecting line 28, onto an electronic counter 29 which, after a programmed number has been reached, gives to the electromagnet 31 via line 30 a signal for closing switch 32. Thereby an electromagnet 33 of a shut-off valve 34 is actuated, which briefly sets valve 34 on air flow. If necessary, oil can additionally be brought to the lubricating points through a manual switch 35 if switch 35 of a shut-off valve 36 is pressed by an operator to set valve 36 on air flow. The valves 34 and 36, which both are to be traversed by only a brief compressed air surge, are supplied with compressed air by the air ducts 39 and 40 and are pushed back to their blocking initial position by springs (not shown).

An air duct or line 42 connected to valve 34 and an air duct or line43 applied at valve 36 are both connected with a valve 37 which acts as OR element, so that either the compressed air surge from valve 34 or the one from valve 36 gets via air duct 44 to an air impulse valve 38 and pushes it into flow position, so that the compressed air current passing through line 41 flows via line 45 to a cylinder type piston pump and pump drive 46, owing to which the piston of pump 46 moves out for its delivering stroke under pressure.

The air ducts or lines 39, 40, 41 are connected by a common air duct 47 and receive via an air duct 48 compressed air source 49.

A part of the compressed air flowing through line 45 is deflected and conducted through a duct or line 45*a*, a time function element 45*b* and a duct or line 45*c* connected at the air impulse valve 38. The time function element 45*b*, e.g. a variable throttle check valve, will, after a given period of time, have let through enough compressed air to actuate valve 38 and to push it back into blocking position.

Thus the compressed air stream acting on the piston of pump 46 is interrupted, and the piston (not shown) of the pump 46 operating as single action cylinder is pushed back into its starting position by a helical spring (not shown) disposed in the cylinder space. The time function element 45*b* is adjusted so that the piston of cylinder 46 executes one delivering stroke per lubrication process. The proportioning of the oil quantity displaced in this stroke is to be effected by a scale (not shown) on pump 46.

Oil from an oil reservoir 50 disposed above the pump 46 is fed to it via the oil line 51. During the delivery stroke this oil is forced via a line 52 into an oil distributor 53. At each exit of this oil distributor 53 the flow of oil to the lubricating point can be adjusted, so that each lubricating point receives the needed dose of oil. This oil reaches the lubricating points through the oil lines 54 to 62.

Check valves 63 and 64 in the oil lines 51 and 52 prevent that during the delivery stroke of the piston of pump 46 oil is forced back into the oil reservoir 50, or respectively that during the return stroke of the piston of pump 46 oil is drawn back from the oil distributor 53 by suction.

In FIG. 2 a loop taker is illustrated, the track of which is to be lubricated.

By the stud 65 the loop taker 18 is non-rotationally secured on the loop taker arbor 17 mounted in the bearing block 16.

The oil line 54 is connected with a nozzle tube 66 provided at a the fixed ring 67. The oil drain 71 of the nozzle tube 66 extends into an oil chamber or recess 72 in hub 68 formed by an annular groove with undercut peripheral face, whence the oil flows through a channel 73 leading obliquely outward when loop taker 18 rotates. Channel 73 ends in a bore 75 formed as a blind hole and provided with an oil carrying wick 74, the bore ending at the running groove 76 of the loop taker body.

Operation

The counting disk 23 with slit-like opening 24 rotates with the main shaft 12. The scanning device 25 with transmitter 26 and receiver 27 records e.g. optoelectronically or electromagnetically each revolution of disk 23, the receiver 27 of the scanning device 25 re laying the signal of transmitter 26, received with every complete shaft revolution through The opening 24, to the electronic counter 29 via the connecting lines 28.

After a number set in counter 29 has been reached, a signal emmission to be forwarded via line 30 takes place, whereupon the electromagnet 31 briefly acts on the spring-loaded switch 32 and thereby closes the circuit of the electromagnet 33 for a moment, to push the pneumatic shut-off valve 34 into flow position. As soon as the circuit of electromagnet 33 is again interrupted by opening of switch 32, the spring of the shut-off valve 34 pushes this valve back into closing position, so that only a brief compressed air surge flows through valve 34. If manual lubricating is to be done, the manual pushbutton 35 of shut-off valve 36 must be pushed briefly, so that a compressed air surge flows through valve 36. As soon as the button 35 is let go, valve 36 is pushed back into closing position.

Depending on whether valve 34 or 36 was actuated, the compressed air surge arriving either from line 42 or from line 43 traverses the valve 37 acting as OR element, so that the surge transmitted through air duct 44 reaches the air impulse valve 38, shifting it in flow direction. in order that the compressed air stream from line 41 traverses valve 38 and acts on the piston of pump 46.

As long as this compressed air stream lasts, the piston pump 46 delivers oil to the oil distributor 53. But as the pump 46 is to execute one stroke only, the compressed air stream must act briefly. Through the time function element 45*b* sufficient pressure has built up before the air impulse valve 38 after a settable time, to push this valve back into its closing position and to interrupt the compressed air stream. The piston of pump 46 then moves back into its starting position under spring action without the compressed air load.

As replacement for the amount of oil given off through oil line 52, pump 46 receives in the form of an flowback oil arrangement under hydrostatic pressure corresponding oil amounts through oil line 51 fed from the oil reservoir 50. Flowback oil arrangement means includes the arrangement of the oil reservoir 50 above pump 46. The amount of oil to be given off by pump 46 is adjusted by a proportioning device or pump drive means on pump 46 which permits a continuously variable adjustment of the volume delivered.

Pump 46 forces the proportional oil quantity through line 52 into the central oil distributor 53, which distributes it over the lines 54 to 62. At each of the exits of the oil distributor 53 a setting device is provided, which makes it possible to feed to each lubricating point the needed, proportioned flow of oil.

All oil lines 54 to 62 connected with the oil distributor 53 are filled with oil, so that each drop supplied into one of these oil lines at the oil distributor 53 immediately displaces a drop of corresponding oil quantity at the conduit ends. The displaced oil drops, having emerged, e.g. from the oil line 54, get into the nozzle tube 66, pass from the nozzle opening 71 into the annular recess or oil chamber 72 of the loop taker hub 68, and traverse the channel 73 extending obliquely outward to bore 75, because the oil drops having entered the channel 73 are forced due to the rotation of the loop taker by the centrifugal acceleration outward into the blind hole bore 75. There a wick 74 disposed in bore 75 absorbs the oil drops and guides them to the running groove 76 of the loop taker body, where they are given off for the lubrication of the loop taker track 77.

While specific embodiments of the invention have been shown and described in detail to illustrate the application of the principles of the invention, it will be understood that the invention may be embodied otherwise without departing from such principles.

What is claimed is:

1. A lubricating device for the track of a rotating lock stitch loop taker of a sewing and embroidering machine, comprising a loop taker body having a hub portion, a rotatable loop taker arbor secured to said loop taker at the hub portion, a bearing block for rotatively mounting said loop taker arbor, said hub portion having a recess which comprises an oil chamber at its end facing said bearing block said arbor passing directly through said oil chamber before reaching the point at which it is secured to said hub portion, a fixed ring surrounding said loop taker hub portion enclosing a space between said hub portion and said bearing block a nozzle tube extending through the opening of said ring protruding into the recess of said loop taker hub portion for directing lubricating oil through an opening of said ring to the recess of said hub portion, a pump connected to said nozzle tube so as to supply lubricating oil to said recess portion, and a channel in said hub portion connecting said recess to the periphery of said loop taker so that the rotation of said loop taker produces a centrifugal force acting on the oil in the recess of said hub portion, to direct the oil, through said channel, to the periphery of said loop taker.

2. A lubricating device according to claim 1, wherein: said sewing machine having a counter which is actuated by motion of a sewing needle to generate a pulse during movement of said needle, means for driving said pump in accordance with the indication of said counter to actuate said pump to deliver lubricating oil through said nozzle tube.

3. A lubricating device according to claim 2, including an oil distributor a connected to said pump, and wherein there are a plurality of loop takers each having a conduit connected thereto and to a nozzle tube directed to each loop taker.

4. A lubricating device according to claim 1, including a sewing machine having a plurality of reciprocating needles, a plurality of loop takers each having a hub portion with an oil chamber therein and each loop taker being rotatably journaled on an arbor, a shaft rotatable in said sewing machine and driving each of said needles, pulse generator means responsive to rotation of said shaft for indicating the number of movements of said plurality of reciprocating needles and said shaft, lubricating pump drive means connected to said pulse means wherein said pump is actuated by movement of said pulse means, and said pump having a discharge nozzle tube passing into each of said oil chambers.

5. A lubricating device for lubrication of a rotating lockstitch loop taker of a sewing and embroidering machine, comprising a loop taker body having a hub portion; a rotatable loop taker arbor secured to said loop taker at the hub portion; bearing block means for rotatively mounting said loop taker arbor; a recess, provided in said hub portion, defining an oil chamber at said hub portion and facing said bearing block; a fixed ring surrounding said loop taker hub portion enclosing a gap between said hub portion and said bearing block, said ring having an opening leading to said recess of said hub portion; a nozzle tube extending through said opening of said ring protruding into the recess of said hub portion, the rotation of said loop taker producing a centrifugal force acting on an amount of oil to direct it to the periphery of said loop taker; a coutner, associated with the sewing machine, which is actuated by motion of a sewing needle to generate a pulse during movement of the needle; and, means for driving a pump in accordance with the pulse generated of said counter to actuate said pump thereby delivering lubricating oil through said nozzle tube.

6. A lubricating device for the track of a rotating lock stitch loop taker of a sewing and embroidering machine, comprising a loop taker body having a hub portion, a rotatable loop taker arbor secured to said loop taker at the hub portion, a bearing block for rotatively mounting said loop taker arbor, said hub portion having a recess at its end facing said bearing block, a fixed ring surrounding said loop taker hub portion enclosing a space between said hub portion and said bearing block, a nozzle tube extending through the opening of said ring protruding into the recess of said loop taker hub portion for directing lubricating oil through an opening of said ring to the recess of said hub portion, a pump connected to said nozzle tube so as to supply lubricating oil to said recess portion, and a channel in said hub portion connecting said recess to the periphery of said loop taker so that the rotation of said loop taker producing a centrifugal force acting on the oil in the recess of said hub portion, to direct the oil, through said channel, to the periphery of said loop taker, said sewing machine having a counter which is actuated by motion of a sewing needle to generate a pulse during movement of the needle, means for driving said pump in accordance with the indication of said counter to actuate said pump to deliver lubricating oil through said nozzle tube in pulsed manner.

* * * * *